United States Patent [19]

Portmann

[11] 4,160,409

[45] Jul. 10, 1979

[54] DRIVE FOR THE MOVABLE WORK COMPONENT, SUCH AS THE RAM OF A PRESS, STAMPING MACHINE OR THE LIKE

[75] Inventor: August T. Portmann, Arbon, Switzerland

[73] Assignee: Bruderer AG, Arbon, Switzerland

[21] Appl. No.: 873,642

[22] Filed: Jan. 30, 1978

Related U.S. Application Data

[63] Continuation of Ser. No. 602,047, Aug. 5, 1975, abandoned.

[30] Foreign Application Priority Data

Sep. 3, 1974 [CH] Switzerland ..... 11979/74

[51] Int. Cl.[2] ..... B30B 5/00

[52] U.S. Cl. ..... 100/257; 74/603; 83/530; 83/615; 83/632; 100/282

[58] Field of Search ..... 74/571 M, 603; 83/530, 83/626, 632, 615, 637, 634, 625; 100/257, 282, 283

[56] References Cited

U.S. PATENT DOCUMENTS

| | | | |
|---|---|---|---|
| 1,569,569 | 1/1926 | Pels | 83/632 |
| 3,147,695 | 9/1964 | Hyman | 83/530 |
| 3,373,596 | 3/1968 | Moeller | 100/257 |
| 3,765,266 | 10/1973 | Portmann | 83/530 |

FOREIGN PATENT DOCUMENTS

| | | | |
|---|---|---|---|
| 2241538 | 4/1973 | Fed. Rep. of Germany | 83/615 |
| 427442 | 6/1967 | Switzerland. | |

*Primary Examiner*—Abraham Hershkovitz

*Attorney, Agent, or Firm*—Ladas, Parry, Von Gehr, Goldsmith & Deschamps

[57] ABSTRACT

A drive or drive arrangement for a movable work component, such as the ram of a punch press, stamping machine or the like, comprising a crosshead driven by a crank drive. At both sides of the crosshead there are hingedly connected one respective end of single-arm levers, the other ends of which are hingedly connected with threaded spindles supported in the machine housing for adjusting the stroke of the drive, and the intermediate bearing or support locations of the levers are hingedly connected via connecting or pressing rods with the ram.

3 Claims, 3 Drawing Figures

DRIVE FOR THE MOVABLE WORK COMPONENT, SUCH AS THE RAM OF A PRESS, STAMPING MACHINE OR THE LIKE

CROSS-REFERENCE TO RELATED APPLICATION

This is a continuation of co-pending application Ser. No. 602,047 filed Aug. 5, 1975 and now abandoned.

BACKGROUND OF THE INVENTION

The present invention relates to a new and improved construction of a drive or drive arrangement for a movable work component, such as the ram of a punch press, stamping machine or the like, comprising a crosshead driven through the agency of a crank drive.

It is a primary object of the present invention to provide an improved drive for a movable work component of a machine, such as the ram of a punch press, stamping machine or the like, which reliably and effectively drives such work component, the drive being relatively simple in construction and design, economical to manufacture, and extremely reliable in operation.

Another object of the present invention aims at the provision of a novel drive for a movable work component of a machine, particularly the ram of a punch press, stamping machine or the like, permitting a substantially symmetrical transmission of the forces from the drive to the work component.

Now in order to implement these and still further objects of the invention, which will become more readily apparent as the description proceeds, the drive or drive arrangement of this development is manifested by the features that at both sides of the crosshead there are hingedly connected or articulated the one respective end of single-arm levers, the other ends of which are hingedly connected with threaded spindles supported in the machine housing, the threaded spindles serving for adjusting the stroke of the drive, and wherein the intermediate bearing means or support locations of the levers are hingedly connected via pressing or compression rods with the ram.

With this arrangement the ram or ram member can be driven at two points, and in the case of essentially parallelly arranged levers or wide levers at four points. Since the inner ends of the single-arm levers, which can be preferably connected at a common hinge point or hinge with the connecting rod and the crosshead, are guided along a substantially linear path of travel, the outer ends of each of the levers must be connected with the associated threaded spindle through the agency of an additionally control lever or guide or via a hinge connection or hinge allowing for transverse movements, for instance through the agency of an additional guide or a sliding block guide with the threaded spindles.

The invention allows for symmetrical transmission of the forces from the drive to the ram, as desired, at two or four points, and adjustment of the stroke of the drive is possible in conventional manner with the aid of the threaded spindles.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
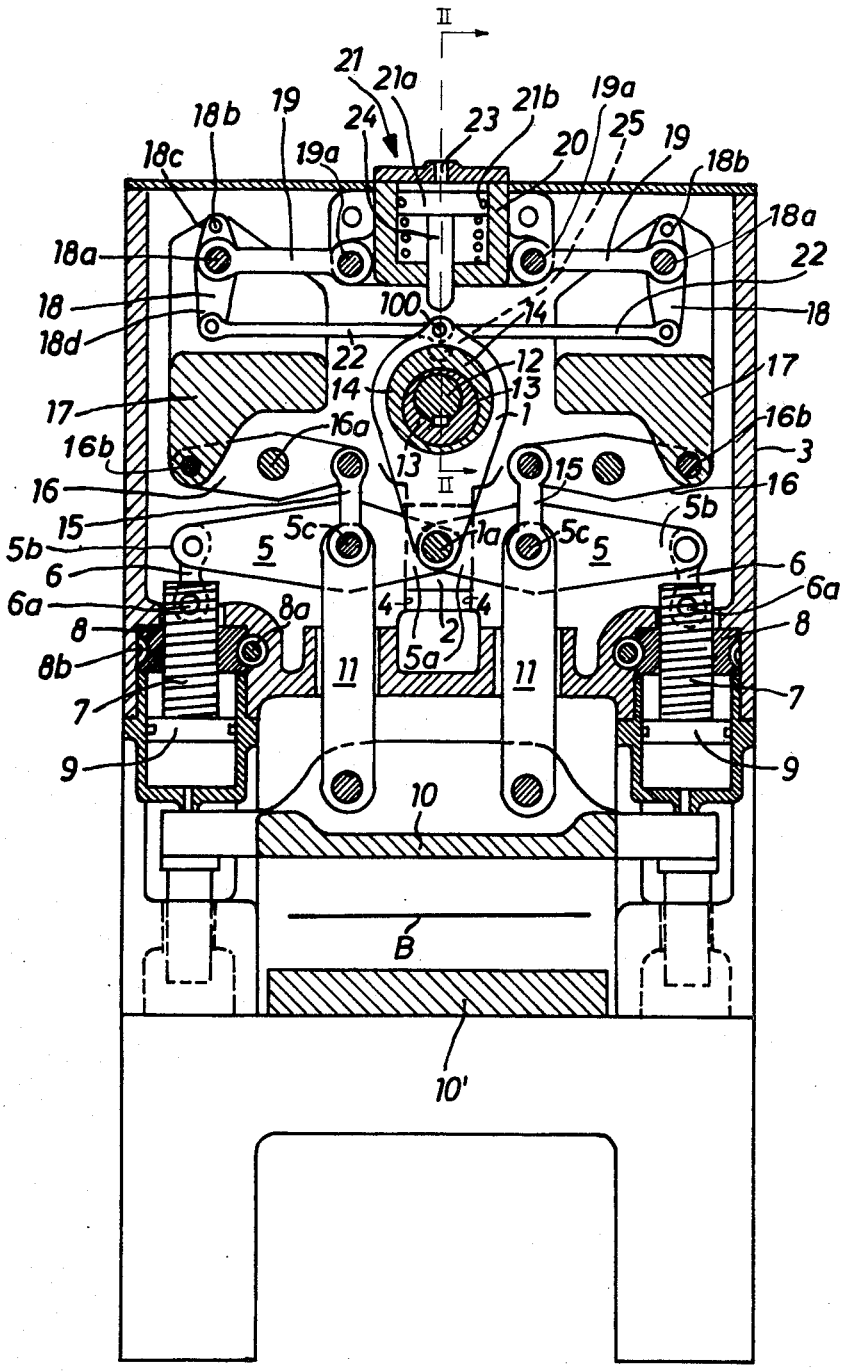
FIG. 1 illustrates in vertical sectional view a press punch or stamping machine equipped with a drive designed according to the teachings of the present invention.

Describing now FIG. 1 of the drawings, wherein it should be understood only enough of the punch press structure has been shown to enable those skilled in the art to understand the principles of the invention, it will be seen that a driven crankshaft 12 which is conventionally mounted in bearings of a machine housing 3 of the punch press or stamping machine—hereinafter simply referred to as a punch press—acts through the agency of a connecting rod 1 upon a crosshead 2 which is slidingly guided in suitable slide guides 4 of the machine housing 3.

At the connection point or hinge means **1*a* connecting the connecting rod 1 with the crosshead 2 there are hingedly mounted the one respective end 5*a* of single-arm levers 5 which extend to both sides of the crosshead 2. The other ends 5*b* of the single-arm levers 5 are hingedly connected via control levers or guides 6 with threaded spindles 7. These threaded spindles 7 are supported through the agency of nut members 8 in the machine housing 3, which nut members 8 are held in the machine housing so as to be axially non-displaceable yet rotatable. For instance, each nut member or nut 8 is adjustable by means of a worm drive or the like, the worm pinion being indicated by reference character 8*a* and the worm gear at the periphery of the nut member 8 by reference character 8*b*. By rotating the nut members 8 the threaded spindles 7 which are prevented from rotating by a not particularly illustrated means, are raised or lowered and thus the position of the hinge point or hinge connection 6*a* of the guide 6 at the associated threaded spindle 7** can be altered and each of which hinge points during operation of the punch press act as a fixed point.

Figure 3:
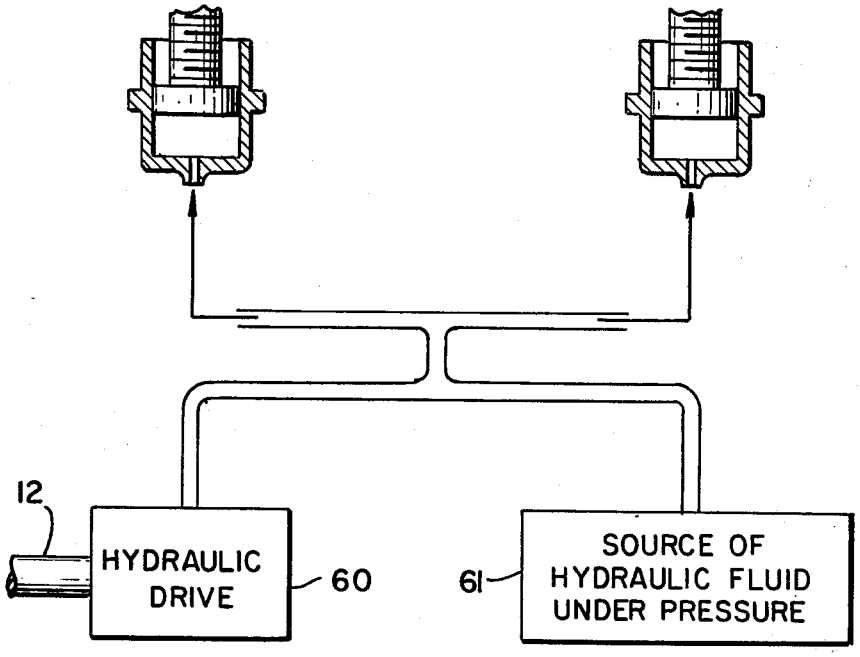
FIG. 3 illustrates diagrammatically the drive of the machine.

The crankshaft 12 is driven by means of a hydraulic drive 60, as illustrated in FIG. 3. The drive 60 receives hydraulic fluid under pressure from a source 61. The conduit connecting the source 61 to the drive 60 is also connected to the cylinders **9*a* in which the pistons 9 are respectively fitted. Therefore, during operation of the punch press the pistons 9 are continually loaded by the pressure of the hydraulic fluid that is used to operate the drive 60 and accordingly the spindles 7 are fixed in the machine housing 3 and the nut members 8 are locked against rotation. With increasing rotational speed of the machine, the pressure acting on each piston is automatically increased and this is particularly advantageous. Conversely, when the drive 60 is stopped, the pressure is reduced and the nut members 8 can then be rotated so that the threaded spindles 7 are moved axially. Use of hydraulic fluid to act on the pistons 9** makes it possible to use pistons of relatively small area owing to the high pressures which can be obtained.

The intermediate bearings or support locations **5*c* of the single-arm levers 5 are connected by means of pressing or connecting rods 11 with a press ram or ram member 10. During driving of the crosshead 2 in a downward direction the intermediate supports or bearings 5*c*** of the levers 5 and thus the pressing or connecting rods 11 together with the ram 10 are likewise displaced downwardly towards a stationary lower table 10' of the punch press in order to be able to punch out parts by means of a not particularly illustrated stamping or punch tool from a workpiece, for instance in the form of a strip or band B which is displaceable between the table 10' and the ram 10 in a given plane of travel.

With the illustrated exemplary embodiment two pressing or connecting rods 11 engage at the ram 10. Consequently, there is formed a so-called "two-point drive". When arranging in each instance two substantially parallel single-arm levers or a wide lever 5 at each side of the crosshead 2 there can be provided for each lever pair or each wide lever two respective pressing or connecting rods 11 for connection with the ram 10. There is then realized a so-called "four-point drive" of the ram 10. Further details of such an arrangement are disclosed in the commonly assigned U.S. application Ser. No. 599,261, filed July 25, 1975, now U.S. Pat. No. 3,998,498, entitled "Apparatus For Guiding A Ram Within The Machine Frame Of A Punch Press", the disclosure of which is incorporated herein by reference. With the embodiment shown the connecting rod 1 of the crank shaft 12 is driven by means of an internal eccentric member 13 connected rigidly therewith and an eccentric bushing or sleeve 14 arranged externally upon such eccentric member 13. The internal or inner eccentric member 13 and the external eccentric bushing or sleeve 14 can be rotated with respect to one another for adjusting the stroke of the drive. Instead of this arrangement the connecting rod 1 also could be driven in a different manner, for instance directly by the offset or crank portion of a crankshaft.

Figure 2:
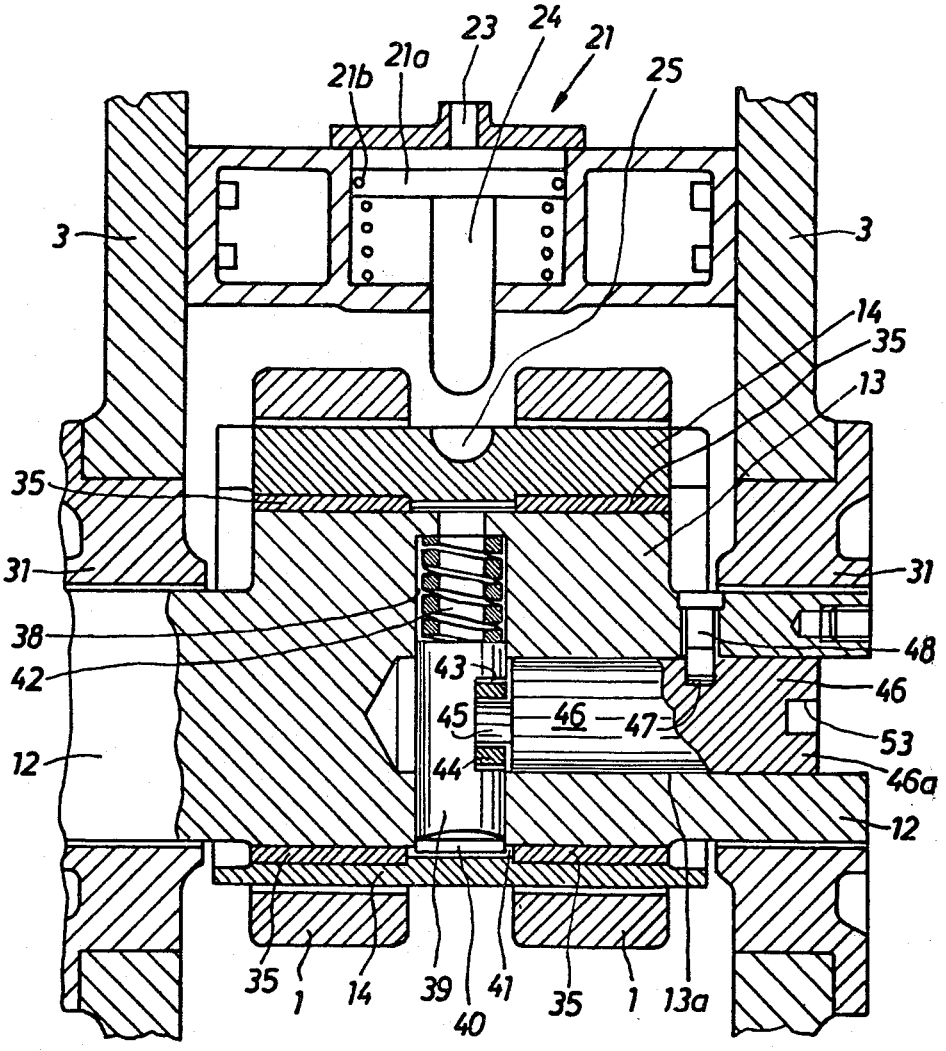
FIG. 2 illustrates, to an enlarged scale, a section taken on the line II—II of FIG. 1.

Further, the crosshead 2 instead of being driven by means of a single connecting rod 1, as described in connection with FIG. 1, can be driven by means of two or more essentially parallelly arranged connecting rods 1, as illustrated in FIG. 2. FIG. 2 also illustrates details regarding the construction of the crank drive. The driven crankshaft 12 mounted in bearings 31 of the machine housing 3 is formed of one piece or integral with the inner eccentric or eccentric member 13. The outer eccentric bushing or sleeve 14 is rotatably mounted upon such inner eccentric member 13 by means of the bearings 35. The eccentric bushing 14 mounts two connecting rods 1.

In a radial bore 38 of the inner eccentric 13 there is guided a locking pin 39 possessing teeth 40 at one end which mesh with inner teeth 41 of the eccentric sleeve or bushing 14. Acting at the outer end of the locking pin 39 is a compression spring 42 which is housed in the bore 38, this compression spring 42 pressing the teeth 40 at the locking pin 39 into meshing engagement with the inner teeth 41 of the eccentric sleeve or bushing 14 and thus fixedly retaining the eccentric bushing or sleeve against rotation upon the inner eccentric member 13. The locking pin 39 has a recess 43 with which engages via a bushing or sleeve 44 an eccentric pin 45 provided at an adjustment spindle 46 which is rotatably mounted in an axial bore **13*a* of the inner eccentric member 13 and the crankshaft 12. The adjustment spindle 46 possesses an annular or ring-shaped groove 47 which extends through an angle of about 180° and with which engages a stop or impact bolt 48 which is threaded into the crankshaft 12 in order to limit the rotation of the adjustment spindle 46 in its terminal or end positions. The adjustment spindle 46 is provided at its outwardly directed end 46*a* with a transverse groove 53 with which there can engage a not particularly illustrated cam or the like of an adjustment mechanism. By rotating the adjustment spindle 46 the locking pin 39 can be displaced against the force of the spring 42 in such a manner that the teeth 40 are brought out of meshing engagement with the internal teeth 41**.

In order to change the eccentricity of the double eccentric formed by the inner eccentric member 13 and the eccentric bushing or sleeve 14 and thus the drive or work stroke of the crank drive, the plunger 24 is pushed into the blindhole bore 25, so that the eccentric bushing or sleeve 14 is fixedly retained. Then by rotating the adjustment spindle 46 the teeth 40 of the locking pin 39 are brought out of engagement with the internal teeth 41 of the eccentric bushing 14. Now by means of the not particularly illustrated adjustment mechanism the crankshaft 12 with the inner eccentric can be rotated relative to the fixedly held eccentric bushing 14. Consequently, there is adjusted the eccentricity and thus the stroke of the crank drive.

Finally, instead of the respective guide or link 6 for connecting the outer ends **5*b* of the single-arm levers 5 with the threaded spindles 7, there can be provided a sliding block connection by means of a guide for the sliding block, which guide extends transversely with respect to the threaded spindle 7**.

With the intermediate bearing **5*c* of each single-arm lever 5 there is connected via a guide or link 15 the one end of a double-lever 16 which is hingedly connected by means of its intermediate support location or bearing 16*a* at the machine housing 3 and at its other end at a compensation weight 17. Instead of using the guide or link 15 there also can be provided an eccentric crank for connecting the intermediate bearing 5*c* of each single-arm lever 5 with the double-lever 16**.

At each compensation weight 17 there is directly hingedly connected at the hinge or pivot means **18*b* the one end 18*c* of a further double-lever 18, the other end 18*d* of which is hingedly connected at location 100 via a first guide or link 22 with the connecting rod 1. The intermediate support or bearing 18*a* of each double-lever 18 is hingedly connected via a second guide or link 19 at a transverse support or carrier 20 which extends in the plane of the stroke essentially parallel to the crankshaft 12, this transverse support 20 being fixedly connected with the machine housing 3. A blocking mechanism 21 is housed in the transverse support 20. This blocking mechanism 21 encompasses a piston 21*a* which is displaceable against the force of a compression or pressure spring 21*b* by means of pressurized medium delivered through an opening 23. The piston 21*a* carries a plunger 24 which protrudes through the base or floor 20 of the transverse support 20 and when the piston 21*a* is advanced coacts with a blindhole bore 25 in the eccentric bushing or sleeve 14** for the fixation thereof when adjusting the stroke of the crank drive. Further details concerning the compensation weight have been described in the copending U.S. application Ser. No. 602,049, filed Aug. 5, 1975 (abandoned in favor of a continuation application Ser. No. 875,037 filed Feb. 3, 1978) now abandoned, and entitled "Apparatus For Mass Compensation At A Machine Driven By A Crank Drive", the disclosure of which is incorporated herein by reference.

Rotation of the crankshaft 12 causes an up and down movement of crosshead 2 in a manner well known for crank drives. This movement of the crosshead 2 causes a corresponding pivoting movement of levers 5, which rotate about their ends 5b connected to links 6. Movement of crosshead 2 in the upward direction causes an upward movement of pressing rods 11, whereby the ram 10 is moved away from the stationary lower table 10'. Downward movement of the crosshead 2 results in a downward movement of the ram 10.

In order to counterbalance the masses moving up and down, the levers 5 are connected via links 15 and double-levers 16 to the compensation masses 17. If the crosshead 2 and the ram 10 move in a downward direction, the compensation masses 17 are moved upwardly due to the pivoting movement of the double-levers 16. During this upward movement of the compensation masses 17, the links 19 pivot about their hinge points 19a. The upward movement of cross-head 2 and ram 10 results in like manner in a downward movement of compensation masses 17.

The same compensation masses 17 serve also to counterbalance the rotating masses of the crank drive 1, 12, 13, 14. Movement of the connecting rod 1 causes a corresponding movement of the links 22 essentially to the right or to the left. Movement of links 22 to the right results in pivoting movement of double-levers 18 about their hingepoint 18a in counterclockwise direction. This movement of these double-levers 18 results in a counterclockwise rotation of the compensation masses 17 about their connection points 16b with double-levers 16. A movement of the links 22 to the left results in like manner in a rotating movement of the compensation masses 17 in a clockwise direction. The rotating masses of the crank drive are therefore counterbalanced by a corresponding movement of the compensation masses 17.

The height of the ram 10 relative to the stationary lower table may be adjusted by rotating the nut member 8 by means of the worm gear 8b and worm pinion 8a, thus raising or lowering the spindle 7 and thereby raising or lowering the end 5b of the lever 5 and the connection point 5c of the pressing rods 11. This adjustment of the height of the ram 10 is independent of the stroke adjustment of the crank drive, which stroke adjustment is described above in connection with FIG. 2.

While there is shown and described present preferred embodiments of the invention, it is to be distinctly understood that the invention is not limited thereto, but may be otherwise variously embodied and practiced within the scope of the following claims.

What is claimed is:

1. A punch press machine comprising:

a machine housing;

a crank drive mounted within the machine housing and including a crankshaft;

hydraulic drive means connected to drive the crankshaft;

source means for providing hydraulic fluid under pressure, said source means being connected to the hydraulic drive means for operation thereof;

a punch member connected drivingly to the crank drive so as to be reciprocated thereby along an axis defined by the machine; and adjustment means whereby the position along said axis of the mean position of said punch member during reciprocation thereof may be adjusted, said adjustment means including an externally threaded spindle member, an internally threaded nut member in threaded engagement with said spindle member, one of said threaded members being connected to said punch member and the other threaded member being so located in the machine that rotation of said other member brings about linear movement of said one member thereby to adjust the mean position of said punch member, said adjustment means further including hydraulic locking means for locking said other member against rotation, said hydraulic locking means being connected to said source means for operation by hydraulic fluid provided thereby.

2. A machine as defined in claim 1, wherein said spindle member is said one threaded member and said nut member is said other threaded member, and wherein said hydraulic locking means comprise a piston connected to said spindle member and a cylinder in which said piston is fitted, said cylinder being connected to said source of hydraulic fluid whereby said piston is biased to lock the spindle member and the nut member against relative rotation.

3. A machine as defined in claim 1, wherein said source means are so connected to the hydraulic drive means and the hydraulic locking means that the locking means operate only during operation of the drive means.

* * * * *